US006676067B2

(12) United States Patent
Granger et al.

(10) Patent No.: US 6,676,067 B2
(45) Date of Patent: Jan. 13, 2004

(54) ANTI-LOOP REEL-HOLDER FLANGE IN A DISPENSING MACHINE FOR WIPE MATERIAL

(76) Inventors: Maurice Granger, 17 rue Marcel Pagnol, Saint Priest en Jarez, 42270 (FR); Daniel Granger, Las Tranchais, Saint Germain de Princay, 85110 (FR); Sabine Granger, 4 Square Violette, Saint Etienne, 42000 (FR); Sméralda Granger, 8 Rue Praire, Saint Etienne, 42000 (FR)

( * ) Notice: Subject to any disclaimer, the term of this patent is extended or adjusted under 35 U.S.C. 154(b) by 0 days.

(21) Appl. No.: 10/194,653

(22) Filed: Jul. 12, 2002

(65) Prior Publication Data

US 2003/0025030 A1 Feb. 6, 2003

(30) Foreign Application Priority Data

Jul. 31, 2001 (FR) ..... 01 10418

(51) Int. Cl.[7] ..... B65H 75/18
(52) U.S. Cl. ..... 242/596.3; 242/596.8
(58) Field of Search ..... 242/596, 596.3, 242/596.8, 563.2, 565, 390.1; 83/335

(56) References Cited

U.S. PATENT DOCUMENTS

| | | | | | |
|---|---|---|---|---|---|
| 1,917,976 | A | * | 7/1933 | Johnson | 83/345 |
| 2,809,790 | A | * | 10/1957 | Kircher | 242/596.3 |
| 4,122,738 | A | | 10/1978 | Granger | 83/314 |
| 4,213,363 | A | | 7/1980 | Granger | 83/298 |
| 5,013,291 | A | * | 5/1991 | Granger | 493/357 |
| 5,758,843 | A | * | 6/1998 | Ongaro | 242/565 |
| 5,868,343 | A | | 2/1999 | Granger | 242/564.4 |
| 5,915,645 | A | * | 6/1999 | Granger | 242/560 |
| 6,098,919 | A | * | 8/2000 | Lewis | 242/596.3 |
| 6,196,102 | B1 | | 3/2001 | Granger | 83/335 |

FOREIGN PATENT DOCUMENTS

| | | | | |
|---|---|---|---|---|
| FR | 2 332 215 | A | | 6/1997 |
| FR | 2 742 737 | A | | 6/1997 |
| FR | 2 771 620 | A | | 6/1999 |
| FR | 2 778 077 | A | | 11/1999 |
| FR | 2 799 946 | A | | 4/2001 |
| JP | 63051249 | A | * | 3/1988 |
| WO | WO 97 24970 | A | | 7/1997 |

OTHER PUBLICATIONS

Granger, "Dispensing Machine For Wipe Material," pending U.S. patent application Ser. No. 10/103,013, filed Mar. 21, 2002.
Granger, "Paper–Wipe Dispensing Machine," pending U.S. patent application Ser. No. 09/576,019, filed May 23, 2000.
Granger, "Apparatus for Dispensing Wiping Materials And Toilet Paper With Automatic Or Semiautomatic Operation," pending U.S. patent application Ser. No. 09/673,408, filed Jan. 17, 2001.

* cited by examiner

*Primary Examiner*—Kathy Matecki
*Assistant Examiner*—Evan Langdon
(74) *Attorney, Agent, or Firm*—Heslin Rothenberg Farley & Mesiti P.C.

(57) ABSTRACT

A reel-holder flange in a dispensing machine for wipe material includes a frame which accommodates a protective cover. The frame has two flanges between which a reel of material, a drum which accommodates a cutting device and any other components are mounted. The reel-holder flanges each accommodate an end fitting which accommodates a core of the reel. An upper part of one of the flanges accommodates a shaft which supports an end fitting. The end fitting accommodates an O-ring seal which protrudes and cooperates which the core of the reel. An elastic return means is disposed between the base of the flange or an associated connecting spacer bar between the flanges in order to fulfil an anti-loop function by cooperating with means for tensioning the return means.

7 Claims, 3 Drawing Sheets

1
b 10
11
16
12
2
5
5.2
12.1
17
13.1
2a
13
8
5.1
8
13.2
2b
15
3

ANTI-LOOP REEL-HOLDER FLANGE IN A DISPENSING MACHINE FOR WIPE MATERIAL

The invention relates to the technical field of dispensing machines for wipe material of the tissue paper type for hand wipe, toilet paper applications and wiping and cleaning in general.

BACKGROUND OF THE INVENTION

The Applicant has developed numerous machines of this type which, as is customary, comprise a housing, a cover, a drum with a built-in cutting blade, said blade being capable of emerging from the drum during operation thanks to means of starting and returning the drum including a cam and a start and return spring located on one lateral side of the drum. Lateral flanges of the housing are designed to support the reel of material which either comes into direct contact with the drum as disclosed in Patent FR 2.332.215 or is in a plane above the drum and does not touch the latter as, for example, in the embodiment described in Patent FR 99.13691.

In this type of machine, a strip of material is cut by the user manually pulling it. Consequently, the tensile force exerted may vary in terms of both its value and direction. This may result in loops forming in the strip of material between the reel of material and the point where the drum which accommodates the cutting device comes into contact with an additional pressure means used to push against the strip of material. This looping is undesirable and the Applicant has already developed several anti-loop device solutions in order to overcome these drawbacks. For example the techniques disclosed in the following French Patents: FR 8903416 and FR 9805866.

SUMMARY OF THE INVENTION

The Applicant's approach has been to work towards a new concept and to simplify the anti-loop device so that it can be adapted for any type of dispensing machine for dispensing material for hand wipes, toilet paper and other wipes of the type where the reel is mounted so that it rests against the drum or does not rest against the drum.

The solution devised by the Applicant solves the problem in question in a simple manner.

According to a first aspect of the invention, the reel-holder flange in a dispensing machine for wipe material of the type comprising a frame which accommodates a protective cover, said frame having two flanges between which the reel of material, the drum which accommodates the cutting device and any other components are mounted, the reel-holder flanges each accommodating an end fitting which accommodates the core of the reel, is distinctive in that the upper area of one of the end flanges accommodates an end fitting support shaft and in that the end fitting accommodates an O-ring seal which protrudes and cooperates with the core of the reel and in that there is an elastic return means between the base of said flange or the associated connecting spacer of the flanges in order to fulfil an anti-loop function by cooperating with means making it possible to tension the return means.

These aspects and others will become apparent from the following description.

BRIEF DESCRIPTION OF THE DRAWINGS

The object of the present invention is described, merely by way of example, in the accompanying drawings in which.

DETAILED DESCRIPTION OF THE INVENTION

Figure 1:
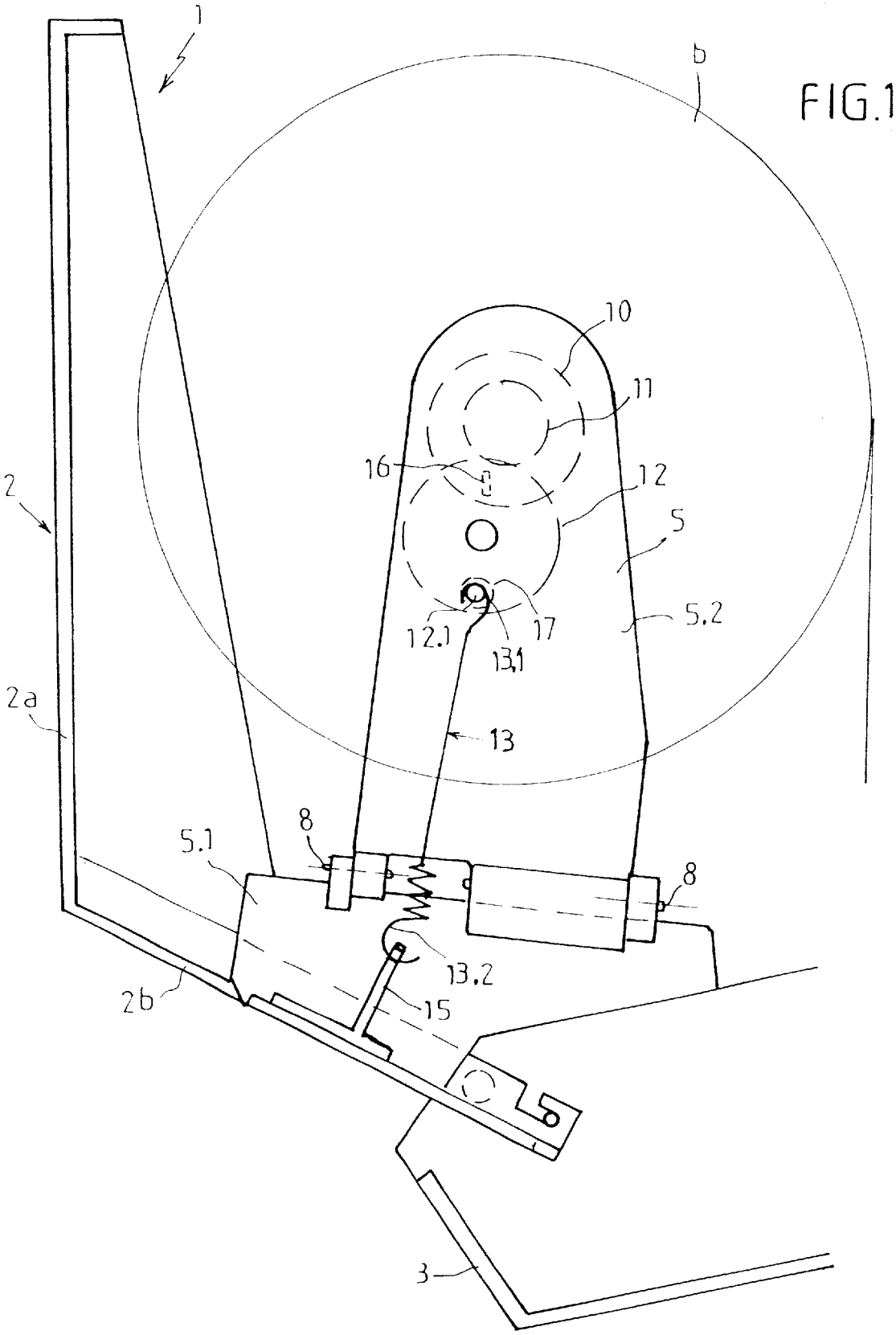
FIG. 1 is a side view of a paper dispensing machine in which the cover has been removed in order to show the anti-loop device in accordance with the invention.
Figure 3:
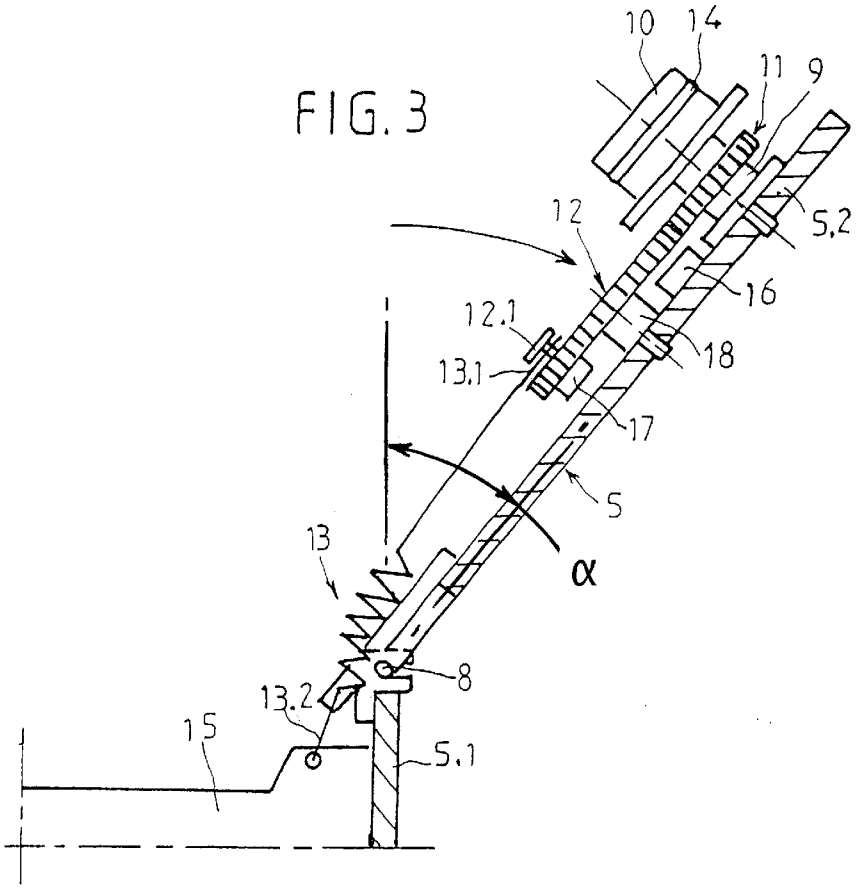
FIG. 3 is a partial view according to FIG. 2 showing the swivelling of a reel-holder flange which supports the device.

In order that the present invention may more readily be understood, the following description is given, merely by way of example, reference being made to the accompanying drawings.

The dispensing machine for wipe material for hand wipe, toilet paper and other wipes is referred to in its entirety as (1). It comprises a frame (2) which successively comprises a back surface **(2*a*) and a lower surface (2*b*) on which a protective cover (3) is hinged. The frame has two flanges (4–5)** between which there is the reel of material (b), the drum which accommodates the device for cutting the strip of material. The drum is not shown in the drawings, neither are the other parts and components which, if applicable, can be built into the dispensing machine and which, in this particular case, are not actually an integral part of the invention and, in particular, the functionality of the latter. This is the reason why the drawings shown essentially illustrate the elements which are necessary in order to understand the invention.

The flange (4) is attached to one of the sides of the machine. It is separately mounted and attached to the frame of the machine by clicking it in or by any other means of temporary connection. The upper part of the flange is designed to accommodate a horizontal shaft (6) which extends as an end fitting (7) capable of penetrating into the core (b1) which supports the reel (b).

According to the invention and in a first embodiment, the other flange (5) located in the same plane as flange (4) comprises two parts (5.1–5.2). A first part or base with a fixed position makes it possible to attach known components on one side such as a drum, a pressure roller, a safety roller or other components. This fixed part extends upward as part (5.2) which is advantageously articulated with the previous part so that it can be spread towards the outside at an angle a which is sufficient to allow the reel of material to be inserted onto the supporting end fittings. The base of this part (5.2) is articulated relative to (5.1) by means of a hinge shaft (8) of the rod type which is mounted and guided along the upper area of fixed part (5.1) of the flange. The upper area of the articulated part (5.2) accommodates a shaft (9) which extends as an end fitting (10) which is in axial alignment with the previous end fitting in order to make it possible to secure the above-mentioned reel of material. The outer part of shaft (9) of the end fitting accommodates an annular gear (11) capable of cooperating with an annular gear underneath it (12) mounted on shaft (18) which is physically joined to articulated part (5.2) of flange (5). This lower annular gear (12) has a protruding point (12.1) which projects on the inside and makes it possible to attach the end (13.1) of an elastic return means (13). The other end (13.2) of said means (13) is attached to a fixed plane, formed either on the fixed part of flange (5) or on a connecting spacer bar (15) between flanges (4 and 5). This return means can be a helical spring or a flexible tab. The position of this means is such that it is involved in swivelling open the articulated part (5.2) of flange (5). The annular gear (12) has a dimensional ratio of 2 to 3 times the diameter of annular gear (11).

Figure 2:
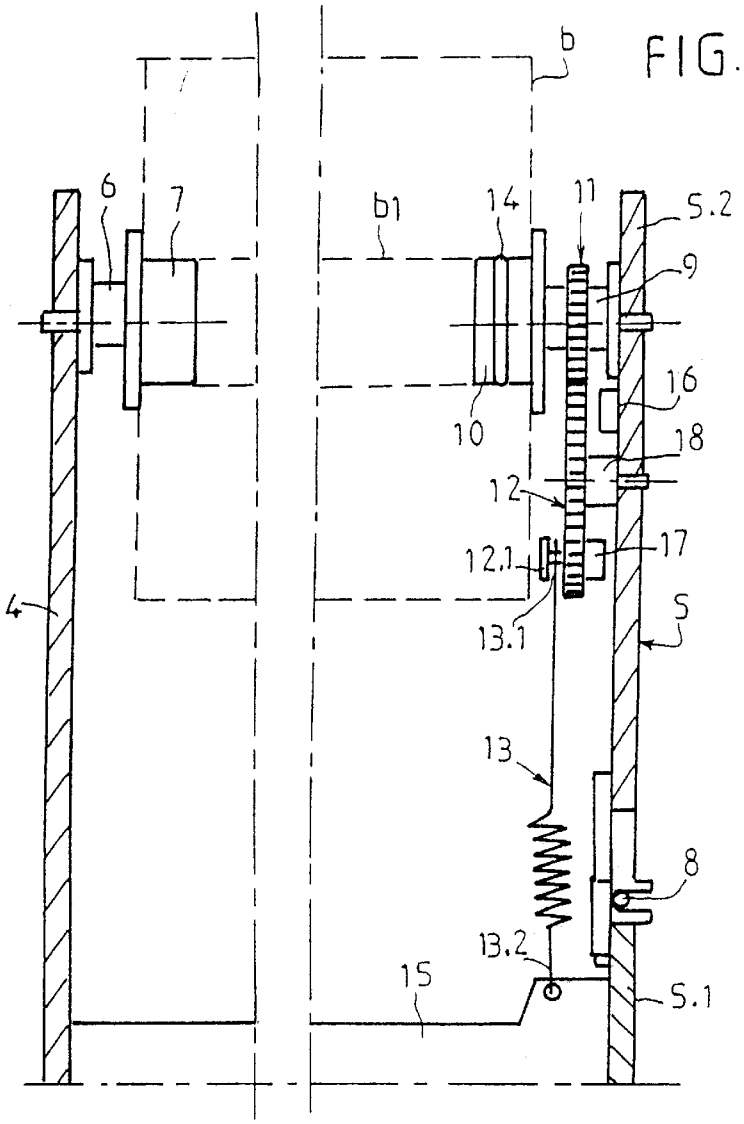
FIG. 2 is a partial front view of a dispensing machine including the device according to the invention shown when it is in use.
Figure 4:
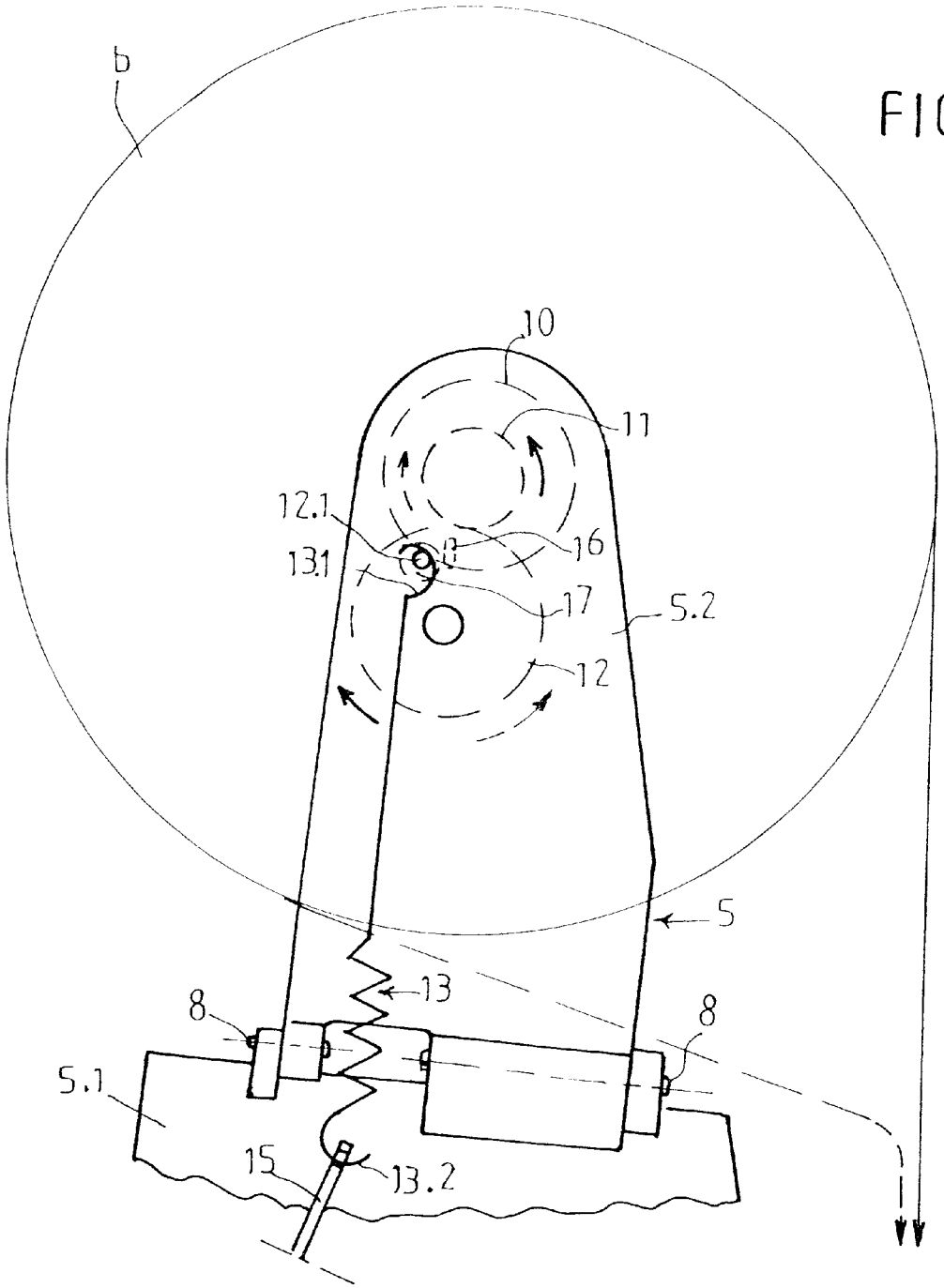
FIG. 4 is a partial side view of the device.

The initial function of means (13) is to return flange (5) into position and, in particular, to the position shown in FIG. 2.

This means (13) in the form of a spring, for instance, is located so that it is substantially located opposite the fixed part of flange (5) whereas its ends are hooked, over a shorter or longer distance, to the spacer bar and annular gear (12).

According to another embodiment of flange (5), the latter is made so that it has a certain amount of elasticity and flexibility, thereby enabling its upper end to be moved aside in order to load the reel of material. In this case, the base of flange (5) may make it possible to attach one end of the return means whereas its upper part is designed to accommodate means fulfilling the anti-loop function referred to previously.

According to another advantageous feature of the invention, the reel placed on the articulated flange has an O-ring seal (14) which slightly protrudes, helps connect the reel of material to the end fitting and causes rotation of the end fitting, when the reel rotates. Thus, when a strip of material of a given size is pulled out of the machine, dispensing a piece of material causes rotation of the reel about itself and therefore, in particular, rotation of end fitting (10) which supports the O-ring seal. This causes rotation of annular gears (11–12) on the articulated flange. The lower annular gear (12), by rotating around itself, causes equivalent displacement of the upper attachment point of the return means and therefore tensions the latter. When the force exerted on the strip of paper is released, simple resilience of the return means allows the reel of material to travel backwards, thereby absorbing and eliminating the looping which results from excessive rotation of the reel of material around itself. The particular dimensional ratio of 2 to 3 of the annular gears means that the material is always tensioned.

The elastic return means is advantageously a helical spring but it can also be made in the form of a flexible tab or the like. The solution devised is therefore simple to implement. The return means can therefore fulfil the dual function of returning the upper part (5.2) of flange (5) to its closed position and, above all, an anti-loop function by causing the reel to reverse by simple resilience of the return means when the user stops exerting the tensile force. In addition, a fixed end stop (16) is connected to the upper articulated or non articulated part (5.2) of flange (5). There is another end stop (17) on annular gear (12) which therefore turns together with the latter. The function of these two end stops (16–17) is to limit the rotation of annular gear (12) by coming into contact with each other, thus acting as a travel limiter. In this way there can be no rotation of annular gear (12) over one revolution and the return means remains controlled without any risk of winding around the opposite-facing end fitting.

The advantages of this embodiment are obvious: simplicity and the low cost of manufacturing and installing the components. The way the return spring is implemented can be selected to control the tensile force and re-winding. The return spring can be made in the form of a flexible tab made of a material which is indestructible even after the reel of material has been loaded and unloaded in the machine many times.

According to another advantage of the invention, annular gears (11–12) can rotate in both directions because there is no means of controlling the direction of rotation. This makes it possible to position the reel of material in both directions. Regardless of the direction in which the reel is installed, the end stops (16–17) limit the rotation of the annular gears relative to each other.

What is claimed is:

1. A reel-holder flange in a dispensing machine for wipe material comprising a frame which accommodates a protective cover, the frame having two flanges between which a reel of material is disposed, the reel-holder flanges each accommodating an end fitting which accommodates a core of the reel, characterised in that an upper part of one of the flanges accommodates a shaft which supports the end fitting, and in that the end fitting accommodates an O-ring seal which protrudes and cooperates with the core of the reel, and in that an elastic return means is located between at least one of a base of the flange and an associated connecting spacer bar between the flanges in order to fulfil an anti-loop function by cooperating with means for tensing the return means, and wherein an outer part of the shaft of the end fitting supports a first annular gear which cooperates with a second annular gear underneath it mounted on a second shaft and joined to the upper part of the flange, the second annular gear having a protruding point attachable to the elastic return means.

2. The reel-holder flange of claim 1 wherein the return means comprises a spring.

3. The reel-holder flange of claim 1 wherein the annular gears have a dimensional ratio of 2 to 3, the second annular gear being the larger, the dimensional ratio ensuring that the strip of material is constantly tensioned.

4. The reel-holder flange of claim 1 wherein the annular gears are freely rotatably mounted so that they turn in both directions and the reel of material is positionable in both directions.

5. The reel-holder flange of claim 1 wherein the upper part of the flange accommodates a fixed end stop whereas the second annular gear accommodates an end stop, the end stops cooperating with each other, on one side or the other, depending on the direction of rotation of the annular gears in order to limit the rotation of the latter.

6. The reel-holder flange of claim 1 wherein the flange comprises two parts, a first or fixed base and an upper part articulated relative to the fixed part, and in that the return means fulfils an additional elastic return function for that part of the flange which is articulated relative to its base.

7. The reel-holder flange of claim 1 wherein the flange is pivotable to allow it to be moved aside in order to insert the reel of material.

* * * * *